US005862687A

United States Patent [19]

Jang

[11] Patent Number: 5,862,687

[45] Date of Patent: Jan. 26, 1999

[54] DRUM WASHING MACHINE

[75] Inventor: Sam Yong Jang, Suwon, Rep. of Korea

[73] Assignee: Samsung Electronics Co., Ltd., Suwon, Rep. of Korea

[21] Appl. No.: 850,516

[22] Filed: May 2, 1997

[30] Foreign Application Priority Data

May 11, 1996 [KR] Rep. of Korea ..... 1996-15705

[51] Int. Cl.[6] ..... D06F 37/06

[52] U.S. Cl. ..... 68/142; 68/24; 68/50

[58] Field of Search ..... 68/3 R, 23.1, 24, 68/38, 140, 142, 139

[56] References Cited

U.S. PATENT DOCUMENTS

| | | | |
|---|---|---|---|
| 1,379,247 | 5/1921 | Carpenter | 68/58 |
| 1,639,491 | 8/1927 | Daniel | 68/142 |
| 2,193,495 | 3/1940 | Rolkern | 68/142 |
| 2,444,603 | 7/1948 | Harvey | 68/142 |
| 2,691,884 | 10/1954 | Walker | 68/142 |
| 2,734,368 | 2/1956 | Richardson | 68/58 |
| 3,017,758 | 1/1962 | Haverstock et al. | 68/140 |
| 3,066,522 | 12/1962 | Steinmuller | 68/140 |
| 4,971,449 | 11/1990 | Hendren | 68/58 |

FOREIGN PATENT DOCUMENTS

| | | | |
|---|---|---|---|
| 596300 | 3/1978 | U.S.S.R. | 134/159 |

OTHER PUBLICATIONS

European Patent Office (EPO) 352,439 68/3R Jan. 1990.

*Primary Examiner*—Frankie L. Stinson

*Attorney, Agent, or Firm*—Burns, Doane, Swecker & Mathis, L.L.P.

[57] ABSTRACT

A drum washing machine includes a spin basket rotatable within a tub about a horizontal axis. Projecting radially inwardly from a cylindrical wall of the spin basket is a plurality of lifters which raise clothes and then let them fall. The lifters form internal spaces into which wash water can flow. That water is raised and then flows downwardly back onto the clothes to increase washing efficiency.

2 Claims, 6 Drawing Sheets

DRUM WASHING MACHINE

BACKGROUND OF THE INVENTION (1) Field of the Invention

The present invention generally relates to a drum washing machine. And more particularly, to improving washing performance by increasing the vigor with which water is circulated within the spin basket.

(2) Description of the Prior Art

A conventional drum washing machine is an electronic appliance that washes clothes using suds created during the rotation of its drum-shaped spin basket. As shown in FIG. 6, a conventional spin basket 1 has a plurality of lifters 2 protruded inward on its side wall so that the elevation of water and laundry contained in the spin basket 1 is more efficiently accomplished. In other words, the water and laundry in the spin basket 1 rise up the spin basket inner wall to a predetermined point, and then fall down from that point in such a manner that the laundry is washed by the suds produced by this rising and falling action. The lifters 2 serve to draw up the water and laundry so as to raise and drop the water and laundry and produce a large amount of suds.

With such a conventional drum washing machine, however, there is a limitation to the enhancement of the washing performance, because the laundry and water drop by interaction between centrifugal force, produced by the rotation of the spin basket 1, and the lifters 2 provided at the inside of the spin basket 1. That is, the laundry and water are lifted by the lifters 2, and the water that has once gone up to a predetermined point (the position where the gravitation force is larger than the centrifugal force acting thereon) must fall down, while the laundry, being a solid, is lifted to a higher point. Thus, the water does not rise high enough, and the amount of lifted water is not enough to generate the amount of suds necessary for washing, thereby lowering the washing efficiency.

SUMMARY OF THE INVENTION

It is an objective of the present invention to provide a drum washing machine which can provide improved washing performance by lifting a greater amount of water for washing to a higher point than and then allowing the water to fall down from that point.

In order to obtain the aforementioned objectives of the present invention, there is disclosed a drum washing machine including: a tub; a spin basket, having a plurality of holes so as to allow water to freely flow between the spin basket and the tub, formed in the tub to be rotatable about a horizontally-supported shaft; lifters protruding to the inside of the spin basket to make the water and laundry rise and drop; and a plurality of water-elevating members for holding the water therein during the rotation of the spin basket and allowing the water to drop down only after it has reached a predetermined point.

The lifters are formed by compressing the spin basket's side surface to its inside in a "V" shape, having a plurality of holes for allowing the spin basket to communicate with the tub. The water-elevating members, each having a body with a plurality of apertures, are provided to cover each lifter's concave backside so as to form a space therebetween, into which the water flows.

The apertures are arranged lengthwise in the body. First guides are provided at one side of each of half the apertures with their free ends extending on an upward angle to the other side thereof. Second guides are provided at one side of each of the second half of the apertures with their free ends extending on an upward angle in the opposite direction as the first half of the apertures.

The coupling portions are formed on both ends of the body so as to be attached to the front and rear panels of the spin basket, and the coupling portions and front and rear panels of the spin basket are joined to each other by a fastening member, thus fixing the lifter supporting members onto the outside of each lifter.

DETAILED DESCRIPTION OF THE PREFERRED EMBODIMENT

The preferred embodiment of the present invention will be now described in detail with reference to the accompanying drawings.

Figure 1:
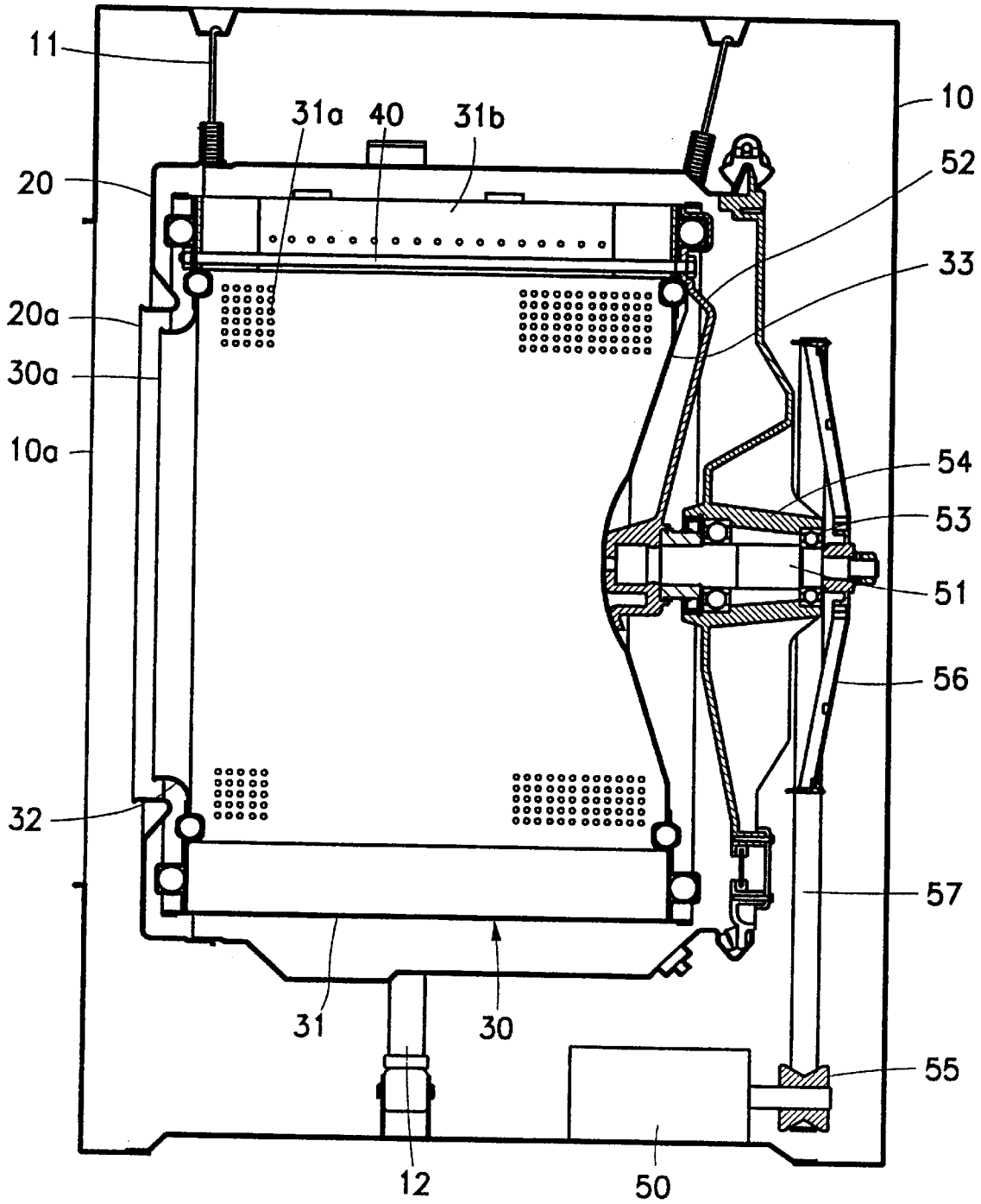
FIG. 1 depicts the interior construction of a drum washing machine in accordance with the present invention.

FIG. 1 is a sectional view showing the overall construction of a drum washing machine in accordance with the present invention.

As shown in FIG. 1, the drum washing machine includes a housing 10, a tub 20 suspended in the housing 10, a spin basket 30 rotatably installed within the tub 20, and an electric motor 50, which rotates the spin basket 30, mounted below the tub 20. The tub 20, which is of cylindrical shape, is installed parallel to the ground in the housing 10, and buffer springs 11 are provided between the housing 10 and the top of the tub 20 to suspend the tub 20 within the housing 10. Under the tub 20 are formed a pair of shock absorbing arms 12. These shock absorbing arms 12 are fixed onto the bottom of the housing 10.

Openings 10*a*, 20*a* and 30*a* are formed on the front of the housing 10, a predetermined spot on the tub 20 corresponding to the front of the housing 10, and a corresponding spot on the spin basket 30, respectively, so that laundry can be put into or taken out of the spin basket 30 therethrough. A door (not illustrated) is provided to open and close the openings 10*a*, 20*a* and 30*a*.

The spin basket 30 consists of a cylindrically-shaped member or side panel 31, and front and rear end panels 32 and 33 respectively joined to the front and back of the side panel 31. The front and rear panels 32 and 33 are firmly fastened to each other by a coupling member. A bolt 40 is used as this coupling member in this preferred embodiment. A plurality of holes 31*a* are uniformly distributed in the side panel 31 so that water can flow freely between the spin basket 30 and the tub 20.

One end of a shaft 51 is connected to the rear panel 33 of the spin basket 30 by means of a flange 52, and the other end extends to the rear of the tub 20. A belt 57 is provided between a first pulley 55, which is connected to the motor 50, and a second pulley 56, which is connected to the shaft 51 so that the rotating force of the motor 50 is transmitted to the spin basket 30 by way of the shaft 51. The shaft 51 is horizontally supported by a pair of bearings 53 that are placed in a bearing housing 54 mounted on the tub 20.

Figure 2:
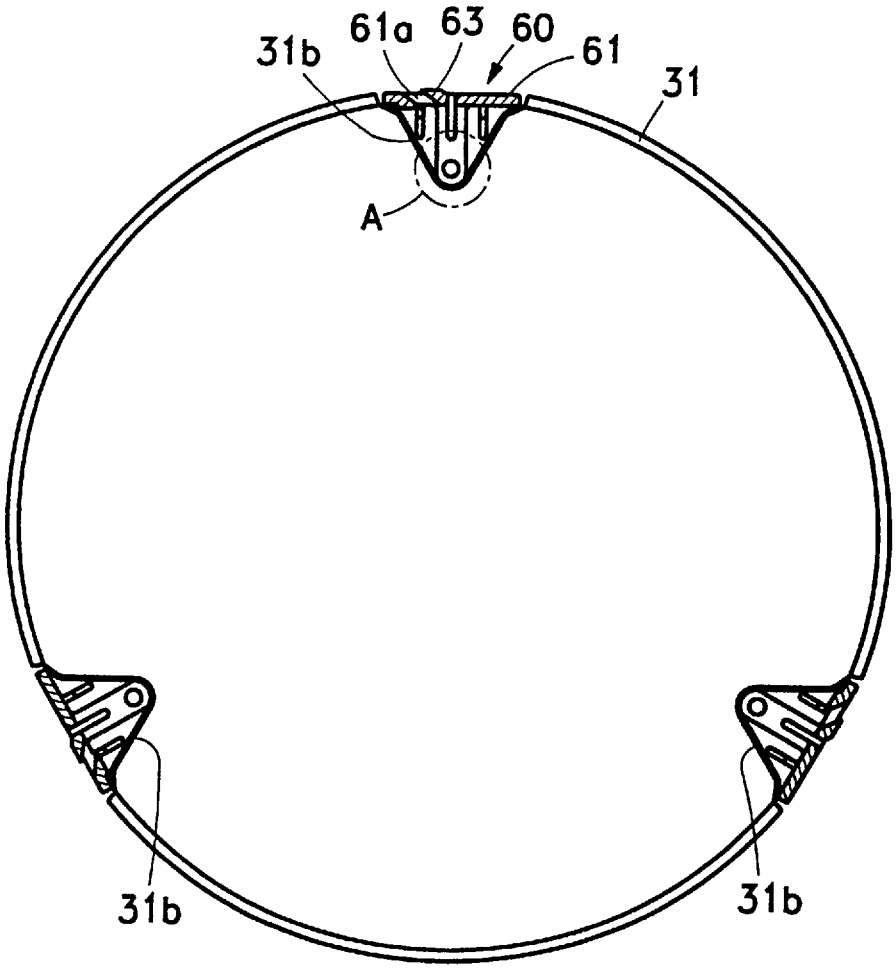
FIG. 2 is a sectional view of a spin basket of FIG. 1.

As shown in FIG. 2, a plurality of lifters 31*b* are formed protruding from the inner side panel 31 of the spin basket 30, and serves to efficiently lift the laundry and water during the rotation of the spin basket 30. These lifters 33*b* are three in number, and are spaced 120° from each other. The lifters 31*b* comprise a wall formed by bending a part of the side panel 31 towards the spin basket center, and extend downward along the spin basket inner surface, the wall thus being V-shaped and formed by first and second wall sections 31*b*' and 31*b*" which converge generally toward a center of the spin basket.

Figure 3:
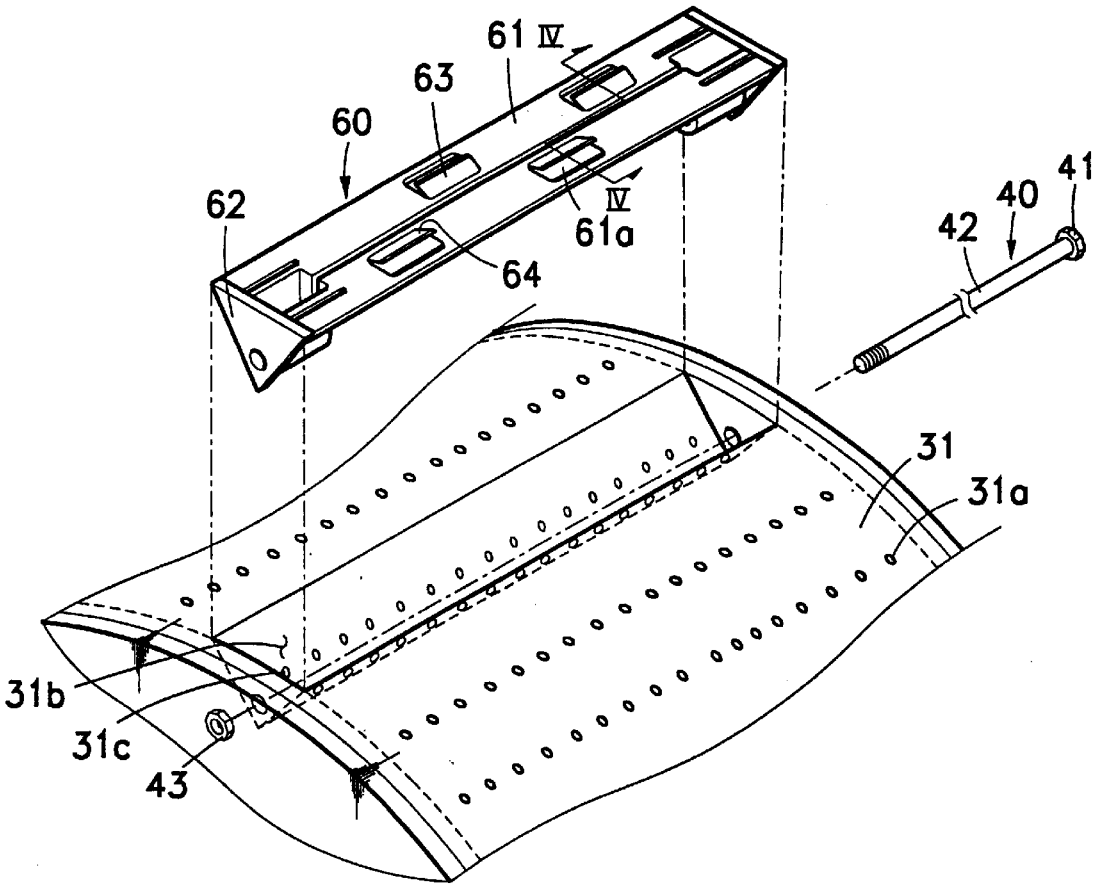
FIG. 3 is an exploded perspective view of the spin basket with a lifter and an inventive water-elevating member.
Figure 4:
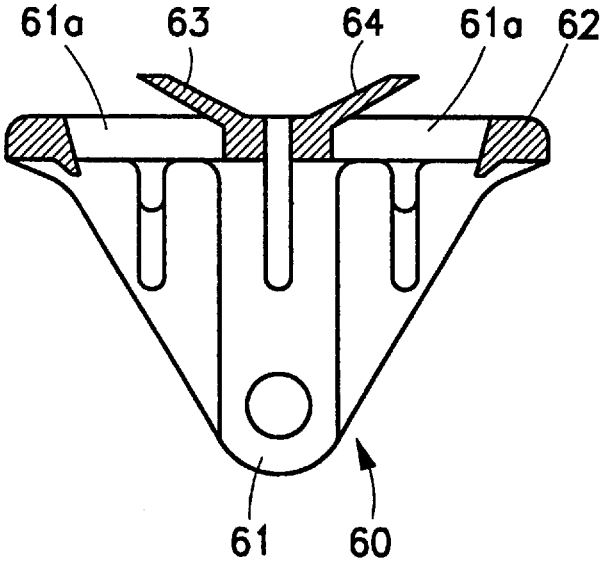
FIG. 4 is a sectional view as taken along line IV—IV of FIG. 3.

The spin basket 30 includes water-elevating members 60 for improving washing efficiency by thoroughly mixing the laundry with the water that they had lifted in addition to the lifters 31*b*. Referring to FIGS. 3 and 4, the water-elevating members 60 are more fully described as follows.

Each of the water-elevating members 60 includes a cover body 61 that is provided to the outside of each lifter 31*b*, covering the concave back of the lifter 31*b*. This forms a space between the water-elevating member 60 and the lifter 31*b*, so that the water flowing into the spin basket 30, is raised to a predetermined point. The body 61 forms a rear wall of the space and has a plurality of apertures 61*a* used to allow the water to freely flow into the space. The apertures 61*a* are arranged lengthwise in two rows on the body 61. First and second guides 63 and 64 are provided to the outside of the apertures 61*a*, thus allowing the water to efficiently flow between the lifter 31*b* and the body 61 during the rotation of the spin basket 30. The first guides 63 for the respective apertures 61*a* on the left of the body 61, are provided on the right side of each of the apertures 61*a*. Each first guide 63 is angled away from the inside of the spin basket 30, and as the spin basket 30 rotates counterclockwise, it makes the inflow of water efficient. The second guides 64 for the apertures 61*a* on the right of the body 61, are extending from the left side of each aperture 61*a* and angled away from the inside of the spin basket 60, thereby making the inflow of water efficient during the clockwise rotation of the spin basket 30.

The water-elevating member 60 is securely fastened to the front and rear panels 32 and 33 by the bolt 40 used to join the front and rear panels 32 and 33 together. Coupling portions 62 of the body 61 are joined to the front and rear panels 32 and 33 by the bolt 40. The bolt head 41 of the bolt 40 is positioned at the rear, and its shank 42 extends passing through the rear panel 33, the coupling portions 62, and the front panel 32 to thereby fasten onto a nut 43. Each coupling portion 62 is of a proper thickness for firmness.

Figure 5:
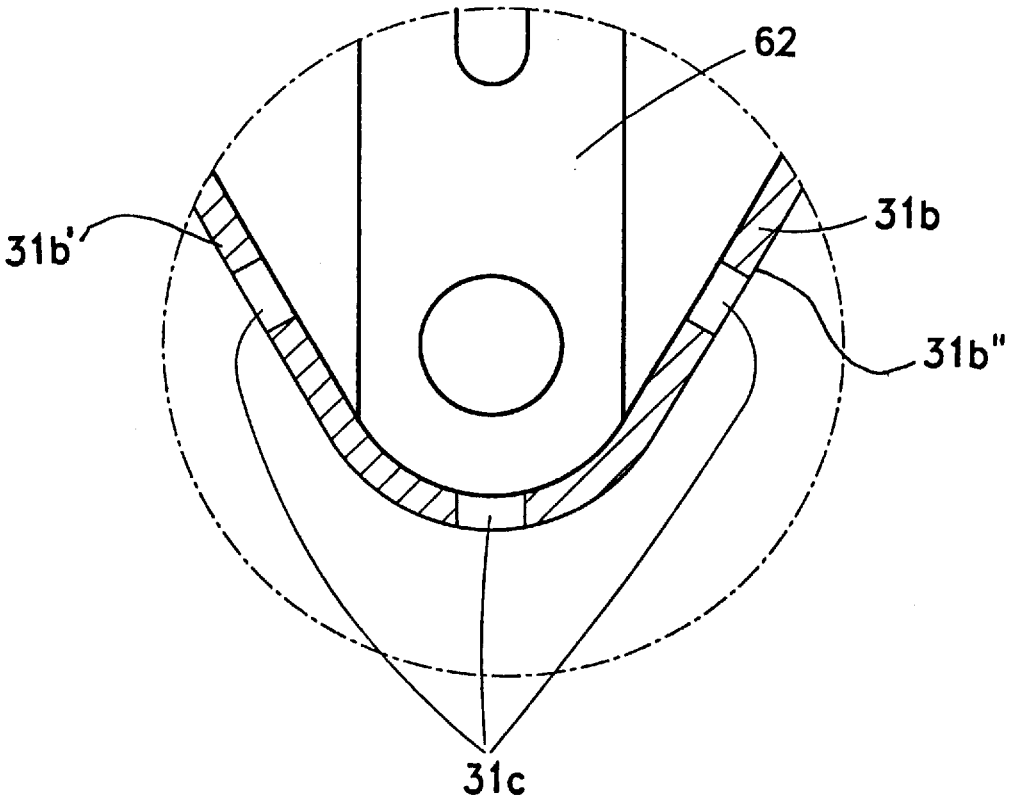
FIG. 5 is an enlarged view of "A" of the encircled segment FIG. 2.
Figure 6:
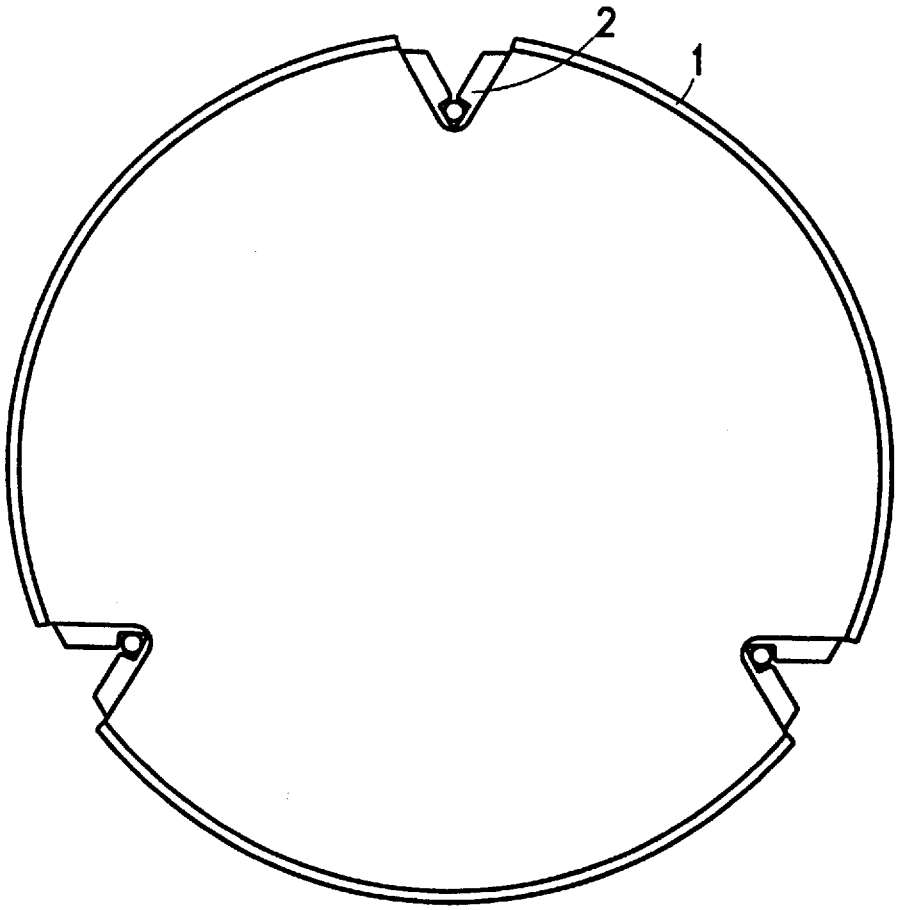
FIG. 6 (PRIOR ART)
FIG. 6 is a sectional view of a spin basket for a conventional drum washing machine.

As shown in FIGS. 3 and 5, both of wall sections 31*b*' and 31*b*" of each of lifters 31*b* have a plurality of holes 31*c* for allowing the spin basket 30 to communicate with the tub 20 so that the water lifted by the water-elevating members 60 drops into the spin basket 30. The holes 31*c* are formed on both side surfaces of the lifter 31*b* and the corner portion between those two side surfaces, thus being arranged in three rows. It is preferable that twenty five holes 31*c* are formed in each row, and the number of the holes 31*c* and the length of extension of each guide 63 and 64 may be manipulated to allow the water to drop from the highest possible point.

The following description concerns the operation of the drum washing machine and its advantages.

Once the motor 50 goes into action to rotate the spin basket 30 and the laundry and water contained therein forward and reverse, the lifters 31*b* carry the laundry and water up to a predetermined point within the spin basket 30 by centrifugal force wherefrom they then fall down. Suds, generated thereby, remove soil from the laundry. The water-elevating members 60, provided to the outside of each lifter 31*b*, lift the water to the outside of the spin basket 30 and then drop it to the inside of the spin basket 30 through the holes 31*c*, thereby enhancing washing efficiency.

More specifically, when the spin basket 30 rotates clockwise, the water flows into the apertures 61*a* of the body 61 by the angled guides 64, and then drops into the spin basket 30 through the holes 31*c*. If the spin basket 30 rotates counterclockwise, the water flows into the apertures 61*a* by the guides 63 that are angled in the opposite direction as the aforementioned guiders 64, and then falls down to the inside of the spin basket 30 via the holes 31*c*. By delaying the falling of the water so that the water falls down from a higher predetermined point forces the removal of soil from the laundry, thus increasing washing efficiency. Should the adjustment be properly made of the shape of each of the holes 31*c* and guides 63 and 64 so as to make the water drop from the highest point of the spin basket 30, the washing efficiency would be even more enhanced.

As described above, in the drum washing machine of the present invention, the water falls out of the lifers down to the inside of the spin basket from the highest possible point, and the suds, produced by the flowing water, remove soil from the laundry. In addition, the water-elevating members are respectively provided to the outside of the lifters, thereby providing improved lifting performance.

What is claimed is:

1. A drum washing machine comprising:

a tub;

a spin basket mounted in said tub for rotation about a horizontal shaft, and having a cylindrical member formed with a plurality of holes to allow water to freely flow between said spin basket and said tub, lifters protruding inwardly from said cylindrical member to make water and laundry rise and drop, each of said lifters including a wall protruding into an interior of said spin basket, said wall including two wall sections converging inwardly generally toward a center of said spin basket and forming a V-shaped space for holding water therein during the rotation of said spin basket, apertures formed in both of said wall sections to enable water to flow from said space and into said interior of said spin basket during rotation of said spin basket in both directions of rotation; and cover bodies attached to said spin basket, each cover body defining an outer periphery of a restrictive one of said spaces, each of said cover bodies including apertures for conducting water into said space and guides for guiding water into said apertures, a first of said guides arranged adjacent a first plurality of said apertures for guiding water from said tub into said space during rotation of said spin basket in a first direction of rotation, and a second of said guides arranged adjacent a second plurality of said apertures for guiding water from said tub into said space during rotation of said spin basket in a second direction of rotation.

2. The washing machine according to claim 1 wherein said spin basket includes a cylindrical side panel, a pair of end panels disposed at respective axial ends of said side panel, and a plurality of bolts extending parallel to said horizontal shaft from one of said end panels to the other end panel for securing said end panels against said side panel, each of said cover bodies including a pair of coupling portions spaced apart in a direction parallel to said shaft, said cover bodies attached to said spin basket by respective ones of said bolts which extend through said coupling portions.

* * * * *